US006160363A

United States Patent [19]

Sugimoto et al.

[11] Patent Number: 6,160,363

[45] Date of Patent: Dec. 12, 2000

[54] CATHODE RAY TUBE HAVING VERTICAL AND HORIZONTAL LINE MISCONVERGENCE CORRECTION

[75] Inventors: Kazuhiro Sugimoto, Ibaraki; Katsuyo Iwasaki, Nishinomiya, both of Japan

[73] Assignee: Matsushita Electronics Corporation, Osaka, Japan

[21] Appl. No.: 09/059,911

[22] Filed: Apr. 14, 1998

[30] Foreign Application Priority Data

Apr. 25, 1997 [JP] Japan ..... 9-109460

[51] Int. Cl.[7] ..... H01J 29/51; H01J 29/56; G09G 1/28; G09G 1/04

[52] U.S. Cl. ..... 315/368.28; 315/370

[58] Field of Search ..... 315/368.28, 370

[56] References Cited

U.S. PATENT DOCUMENTS 3,781,590 12/1973 Chapman ..... 315/27 SR 5,142,205 8/1992 Yabase et al. ..... 315/368.28

5,523,658 6/1996 Fukuma et al. ..... 315/368.19

FOREIGN PATENT DOCUMENTS 07288829 10/1995 Japan .

*Primary Examiner*—Seungsook Ham

*Assistant Examiner*—John Patti

*Attorney, Agent, or Firm*—Akin, Gump, Strauss, Hauer & Feld, L.L.P.

[57] ABSTRACT

A color picture tube apparatus comprising a YH correction circuit connected to a vertical deflection coil in series and having YH correction coils for generating four-pole magnetic fields, the YH correction circuit being formed of a double bridge circuit, wherein a diode bridge circuit is connected to at least one resistor in parallel, two resistors connected in series are connected to a variable resistor in parallel, the parallel connection is further connected across the output terminals of the diode bridge circuit, and the YH correction coils are connected between the connection point of the two resistors and the movable terminal of the variable resistor.

9 Claims, 11 Drawing Sheets

CATHODE RAY TUBE HAVING VERTICAL AND HORIZONTAL LINE MISCONVERGENCE CORRECTION

BACKGROUND OF THE INVENTION

The present invention relates to a color picture tube apparatus which is used for television sets, computer displays, etc.

A color picture tube having an in-line electron gun at its neck portion is provided with a self-convergence deflection yoke to make three electron beams converge to the same spot on a screen. In actual practice, however, complete convergence cannot always be obtained at all portions on the screen of the color picture tube, even when the self-convergence deflection yoke is used. Misconvergence may occur depending on the design of deflection magnetic fields, variations in assembled components, etc.

In order to correct such misconvergence, a correction coil for generating a magnetic field which corrects misconvergence, and a correction circuit for controlling current flowing through the correction coil are connected to the deflection yoke of a conventional color picture tube.

FIGS. 9 and 10 show schematic views for explaining states of misconvergence in a color picture tube. FIG. 9 shows vertical line (hereinafter is referred to as YH) misconvergence developed at the top and bottom ends of a vertical line displayed at the screen center of a color picture tube. FIG. 10 shows horizontal line (hereinafter referred to as "YV") misconvergence developed at the top and bottom ends of the screen center of a color picture tube.

As means for correcting the YH misconvergence shown in FIG. 9, on the electron gun side of the deflection yoke, two YH misconvergence correction coils used in a pair are disposed above and below the electron gun unit so as to generate four-pole YH correction magnetic fields. With this configuration, currents flowing through the YH misconvergence correction coils are controlled by a YH correction circuit.

As means for correcting the YV misconvergence shown in FIG. 10, YV correction coils are disposed above and below the electron beam unit so as to sandwich it. Furthermore, the YV correction coils are wound so that the same magnetic pole generation portions at the ends of each coil are disposed opposite to each other when currents flow in the YV correction coils. The currents flowing through the YV misconvergence correction coils are controlled by the YV correction circuit in order to correct YV misconvergence.

Two conventional color picture tubes relating to the present invention will be described below.

FIG. 11 shows a YH correction circuit for correcting misconvergence developed at a deflection yoke, disclosed in Japanese Laid-open Patent Application, Publication No. 7-288829. The YH correction circuit shown in FIG. 11 will be described below as a first prior art color picture tube.

As shown in FIG. 11, in a deflection yoke mounted on a color picture tube in accordance with the first prior art, a diode bridge circuit having four diodes D1, D2, D3 and D4 is provided inside a YH correction circuit 100.

Fixed resistors R1, R2 are connected across the input terminals d, e of the diode bridge circuit. Comatic aberration correction coils L1, L2 are connected in series between the YH correction circuit 100 and a vertical deflection coil 101. In addition, YH correction coils L3, L4 are connected between a movable terminal C of a variable resistor VR1 and a connection point of the fixed resistors R1, R2. When the movable terminal C of the variable resistor VR1 is at the electrical center of the range between fixed terminals A, B, the bridge circuit is designed so as not to allow current to flow between the movable terminal C of the variable resistor VR1 and the connection point of the resistors R1, R2.

The first prior art configured as described above has been used to adjust positive and negative misconvergence owing to vertical deflection magnetic fields, thereby to enhance the quality of the color picture tube.

A second prior art color picture tube will be described below. The second prior art is obtained by connecting the deflection yoke of the first prior art to a YH correction circuit and a YV correction circuit in series.

As shown in FIG. 12, a block diagram showing an example of circuit configuration of a conventional correction circuit, a YH correction circuit 16 and a YV correction circuit 17 are used as independent circuits and connected in series in the conventional deflection yoke. Since the correction circuits are connected in series in the deflection yoke, it is important to reduce the resistance value inside each correction circuit or the resistance value of the vertical deflection coil itself in order to prevent loss in the circuit.

In the above-mentioned first prior art, the YH correction coils L3, L4 are connected in series between the movable terminal C of the variable resistor VR1 inside the diode bridge circuit and the connection point between the fixed resistors R1, R2. Therefore, the current flowing through the YH correction coils L3, L4 flows through one of the fixed resistors R1 and R2 at all times, thereby causing a problem of lowering sensitivity.

Furthermore, reducing the resistance values of the correction circuits and the correction coil has a limit in the second prior art. Therefore, it is difficult to attain significant reduction in the resistance values. Moreover, reducing the circuit resistance values of main coils such as the vertical deflection coil is also limited with regard to temperature characteristics and performance characteristics. Therefore, it is also difficult to reduce large resistance values.

BRIEF SUMMARY OF THE INVENTION

The present invention is intended to solve the problems encountered in the above-mentioned first and second prior art color picture tube. The object of the present invention is to provide a color picture tube apparatus capable of delivering the sensitivity of a correction circuit to a maximum, and to provide a color picture tube apparatus capable of reducing a large resistance value of the correction circuit.

In order to attain the above-mentioned object, the color picture tube apparatus of the present invention comprises:

a color picture tube provided with an in-line electron gun at the neck thereof; and a deflection yoke used with the color picture tube and having a horizontal deflection coil for generating a horizontal deflection magnetic field distorted in a pincushion shape and a vertical deflection coil for generating a vertical deflection magnetic field distorted in a barrel shape, wherein the deflection yoke has a YH correction circuit connected to the vertical deflection coil in series, and the YH correction circuit has a double bridge circuit, in which a diode bridge circuit is connected to at least one resistor in parallel, two resistors connected in series are connected to a variable resistor in parallel as a parallel connection, the parallel connection is further connected across the output terminals of the diode bridge circuit, and the YH correction coils provided on the electron gun side of the deflection yoke are connected between the connection point of the two resistors and the movable terminal of the variable resistor.

In the color picture tube apparatus of the present invention having the above-mentioned configuration, the resistor disposed in parallel with the diode bridge circuit is required to provide a diode-on voltage for at least two diodes and to have a constant resistance value. Therefore, when the diodes are on, almost the entire current flowing through the YH correction circuit flows through the diode bridge. For this reason, by properly adjusting the variable resistor, highly sensitive current flows through the YH correction coil, and the maximum YH correction magnetic field can be generated. Therefore, the present invention can provide a color picture tube apparatus having highly sensitive YH correction coils.

The color picture tube apparatus of the present invention comprises:

a color picture tube provided with an in-line electron gun at the neck thereof; and a deflection yoke used with the color picture tube and having a horizontal deflection coil for generating a horizontal deflection magnetic field distorted in a pincushion shape and a vertical deflection coil for generating a vertical deflection magnetic field distorted in a barrel shape, wherein the deflection yoke has a parallel connection of a YH correction circuit and a YV correction circuit connected in parallel, and the parallel connection is connected to the vertical deflection coil in series.

In the conventional apparatus, the shunt ratio of currents in the circuits of the YH or YV correction circuit is controlled by using a resistor. In the color picture tube apparatus of the present invention, however, the YV correction circuit or the YH correction circuit, that is, the other correction circuit of the parallel connection, is used instead of the resistor. Therefore, with the color picture tube apparatus of the present invention, the resistor used for the conventional apparatus can be eliminated, and the resistance value of the correction circuit can be reduced significantly.

In the color picture tube apparatus of the present invention, the YH correction circuit and the YV correction circuit each include diodes.

Therefore, in the color picture tube apparatus of the present invention, provided that the diodes of the YH correction circuit are only made symmetrical with the diodes of the YV correction circuit with respect to the diode characteristics and quantity, even if the resistance values of the diodes of either YH correction circuit or YV correction circuit are changed owing to their temperature characteristics and the like, the remaining diodes of either YV correction circuit or YH correction circuit are also changed in completely the same way with respect to their temperature characteristics. For this reason, any change owing to the temperature characteristics is not generated in the shunt ratio between the two correction circuits. Consequently, with the present invention, any change owing to the temperature characteristics can be eliminated from convergence corrected by the correction circuits and residual misconvergence after adjustment.

In the color picture tube apparatus of the present invention, the YH correction circuit and the YV correction circuit each include a bridge circuit.

Therefore, even if the shunt ratio in the bridge of one of the two correction circuits is changed by a variable resistor or the like, in the case that the other correction circuit is constructed by a bridge circuit, the effect of the change in the shunt ratio on the other correction circuit itself is significantly less than an effect obtained in case of the other correction circuit having an ordinary control circuit. This is attained because substantially active elements, such as variable resistors and correction coils, are connected across the output terminals of the bridge circuit. In other words, even if a change is caused between the output terminals of one of the bridge circuits, the effect of the change is hardly transmitted to the output terminals of the other bridge circuit. Consequently, with the color picture tube apparatus of the present invention, mutual interference can be reduced between the YH correction circuit and the YV correction circuit in the correction circuit.

In the color picture tube apparatus of the present invention, the YH correction circuit is provided on the electron gun side of the deflection yoke.

Therefore, with the present invention, the shunt current flowing through the circuit on the side of the YH correction circuit can be used effectively to a maximum, whereby the sensitivity of the YH correction coil can be raised.

While the novel features of the invention are set forth particularly in the appended claims, the invention, both as to organization and content, will be better understood and appreciated, along with other objects and features thereof, from the following detailed description taken in conjunction with the drawings.

It will be recognized that some or all of the Figures are schematic representations for purposes of illustration and do not necessarily depict the actual relative sizes or locations of the elements shown.

DETAILED DESCRIPTION OF THE INVENTION

First Embodiment

Figure 1:
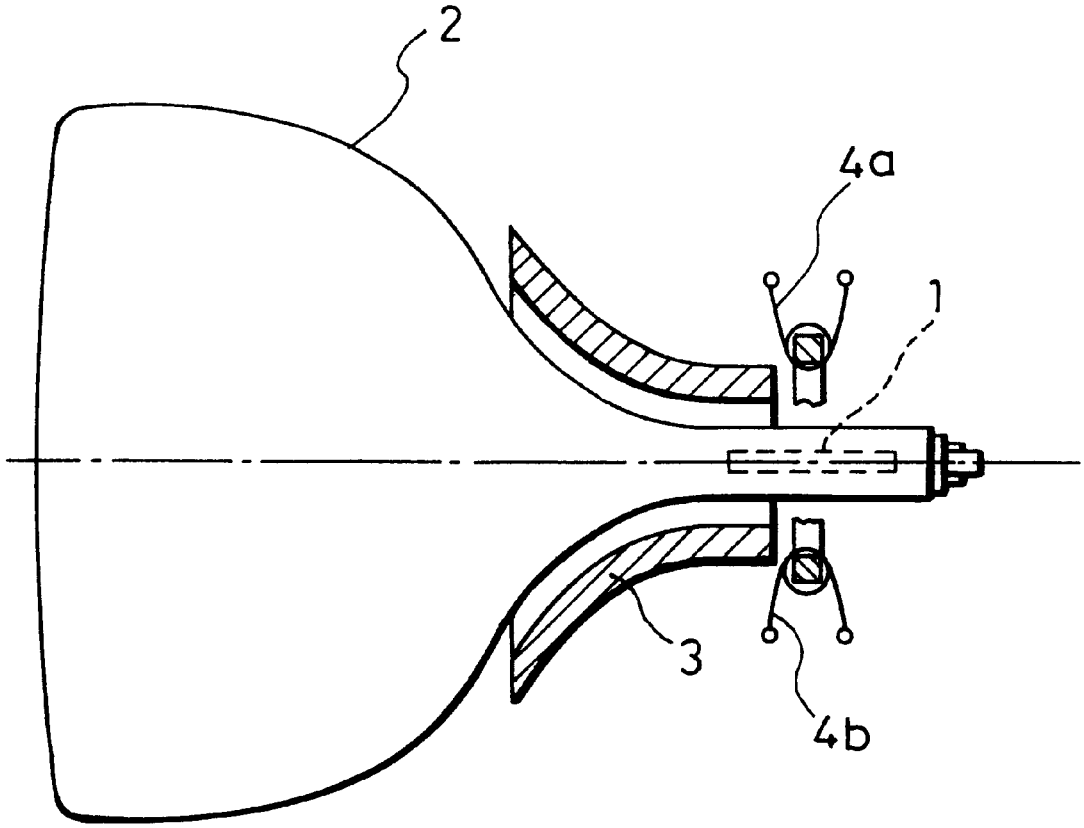
FIG. 1 is a schematic side view showing a color picture tube apparatus in accordance with a first embodiment of the present invention.

A first embodiment of the present invention will be described below referring to the accompanying drawings. FIG. 1 is a schematic side view showing a color picture tube apparatus in accordance with the first embodiment, and FIG. 2 is a view showing a YH correction circuit for a deflection yoke in a color picture tube apparatus in accordance with the first embodiment.

As shown in FIG. 1, a self-convergence deflection yoke 3 is mounted on a color picture tube containing an in-line electron gun 1 at its neck portion.

Figure 2:
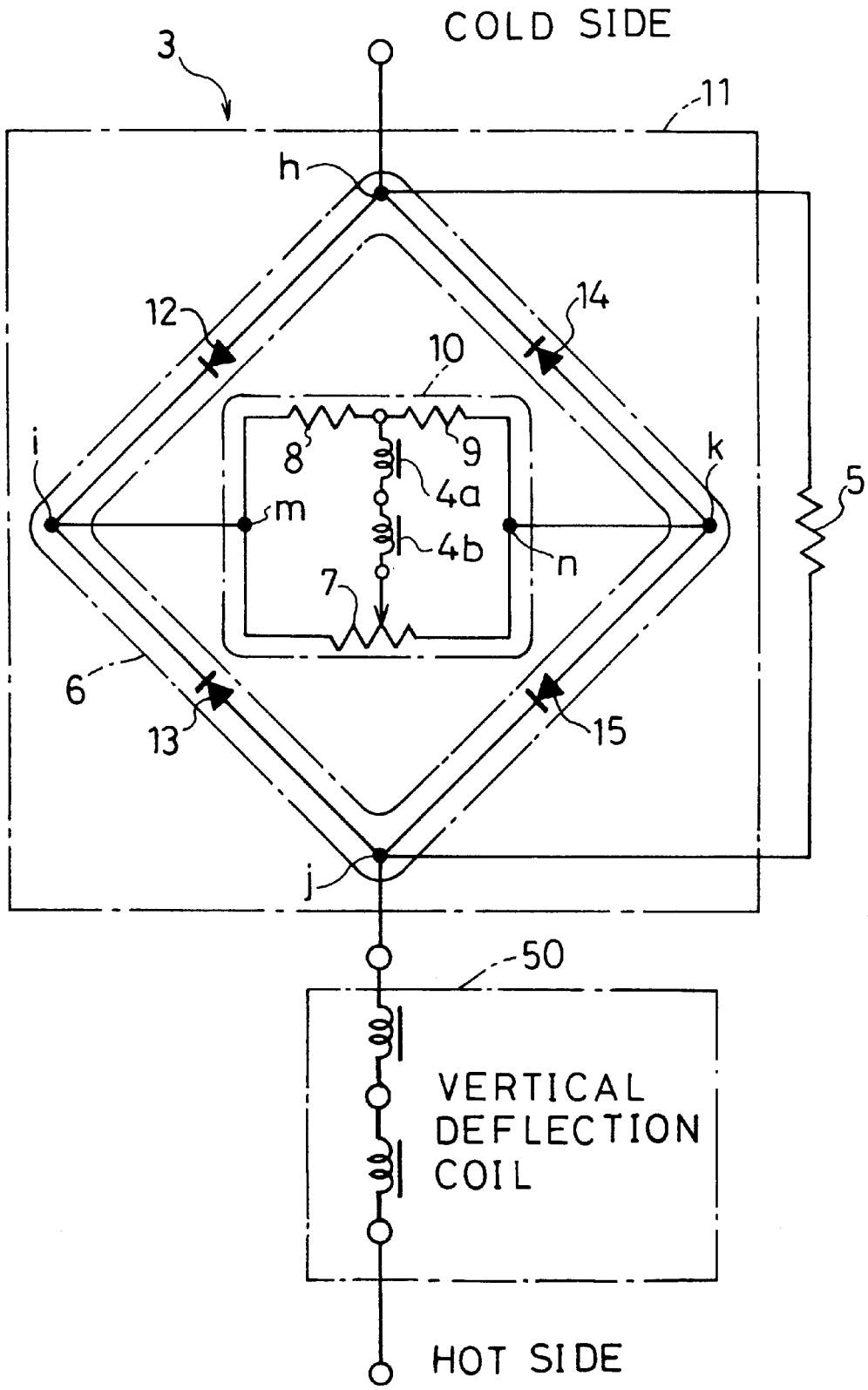
FIG. 2 is a circuit diagram showing a YH correction circuit in accordance with the first embodiment of the present invention.

As shown in FIG. 2, a YH correction circuit 11 for the deflection yoke 3 in accordance with the first embodiment is connected to a vertical deflection coil 50 in series. This YH correction circuit 11 is provided with a diode bridge circuit 6 comprising four diodes 12, 13, 14 and 15. A resistor 5 is connected between the input terminals h, j of the diode bridge circuit 6. In addition, a bridge circuit 10 is connected between the output terminals i, k of the diode bridge circuit 6. In the bridge circuit 10, two resistors 8, 9 connected in series are connected to a variable resistor 7 in parallel, and the movable terminal of the variable resistor 7 is connected to the connection point of the two resistors 8, 9 via a set of YH correction coils 4*a*, 4*b* for generating four-pole magnetic fields.

As described above, the YH correction circuit 11 in accordance with the first embodiment has a double bridge circuit comprising the diode bridge circuit 6 and the bridge circuit 10.

Figure 3:
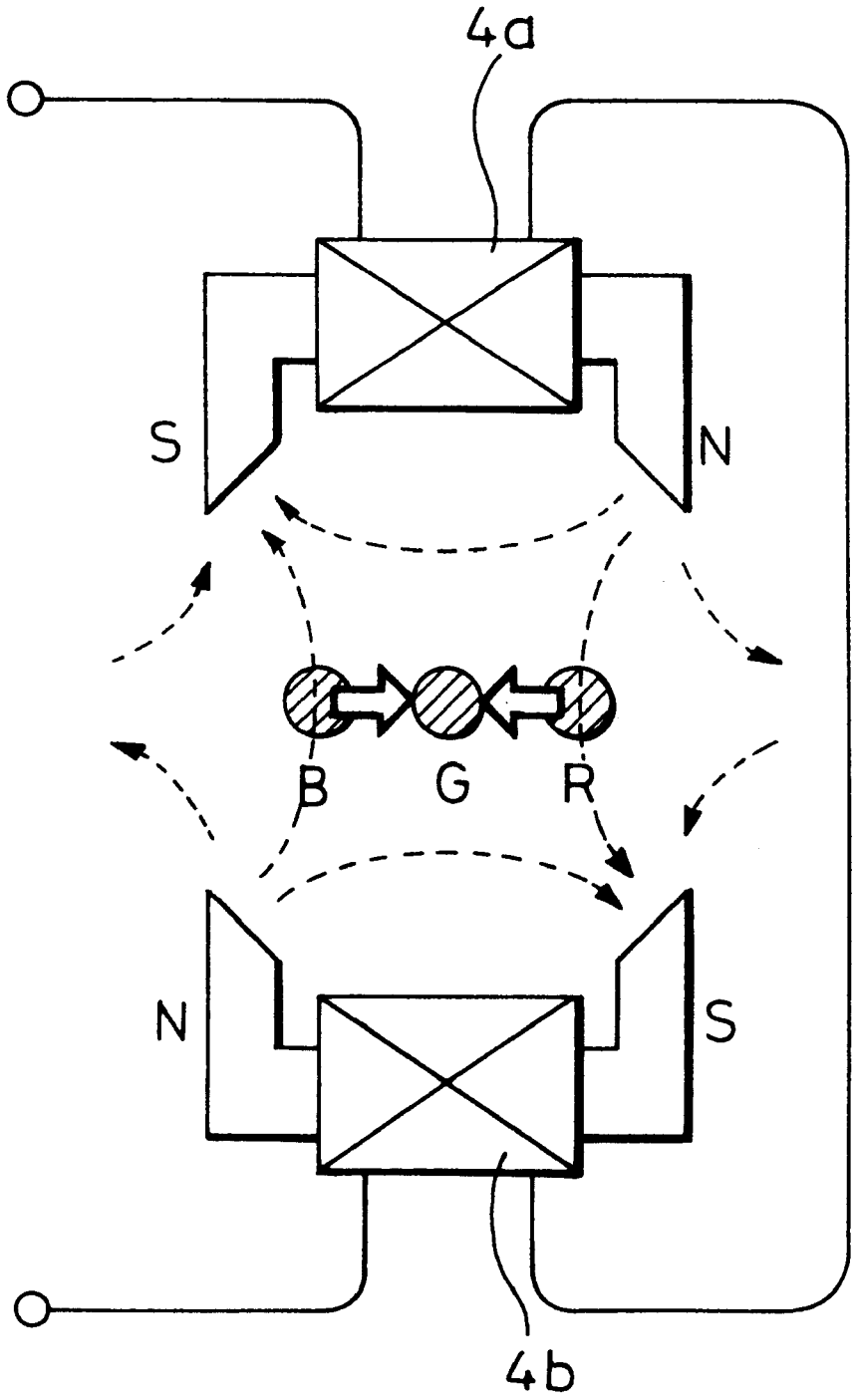
FIG. 3 is a schematic view showing YH correction coils in accordance with the first embodiment of the present invention.

FIG. 3 is a view illustrating magnetic fields generated by the set of YH correction coils 4*a*, 4*b* in accordance with the first embodiment. As shown in FIG. 3, four-pole correction magnetic fields are generated by the set of YH correction coils 4*a*, 4*b*, and electron beams on both sides are corrected inwardly.

In addition, the YH correction coils 4*a*, 4*b* in accordance with the first embodiment can generate four-pole correction magnetic fields having directions opposite to those described above, and can correct the electron beams on both side outwardly.

The YH correction coils 4*a*, 4*b* shown in FIG. 3 for generating the four-pole correction magnetic fields are provided on the electron gun side of the deflection yoke 3. The YH correction coils 4*a*, 4*b* for generating the four-pole correction magnetic fields are disposed symmetrically to each other with respect to the horizontal and vertical axes of the deflection yoke 3 so that YH miss convergence can be corrected on each of the N and S sides.

According to an experiment conducted by the inventors, in the case that two sets of YH correction coils 4*a*, 4*b*, each having about 40 turns of wire 0.4 mm in diameter, were used, when the maximum YH misconvergence of 0.3 mm on the Y axis (the vertical axis of the deflection yoke) was corrected, a current of 100 mA or more was required conventionally. In the present embodiment, however, such misconvergence was able to be corrected by a vertical deflection current of 50 mA, about half of the current required conventionally. According to the results of the experiment, it is understood that a supersensitive YH correction system requiring about half or less of the current required in the conventional YH correction circuit is obtained by using the YH correction circuit in the color picture tube apparatus in accordance with the first embodiment.

Second Embodiment

Figure 4:
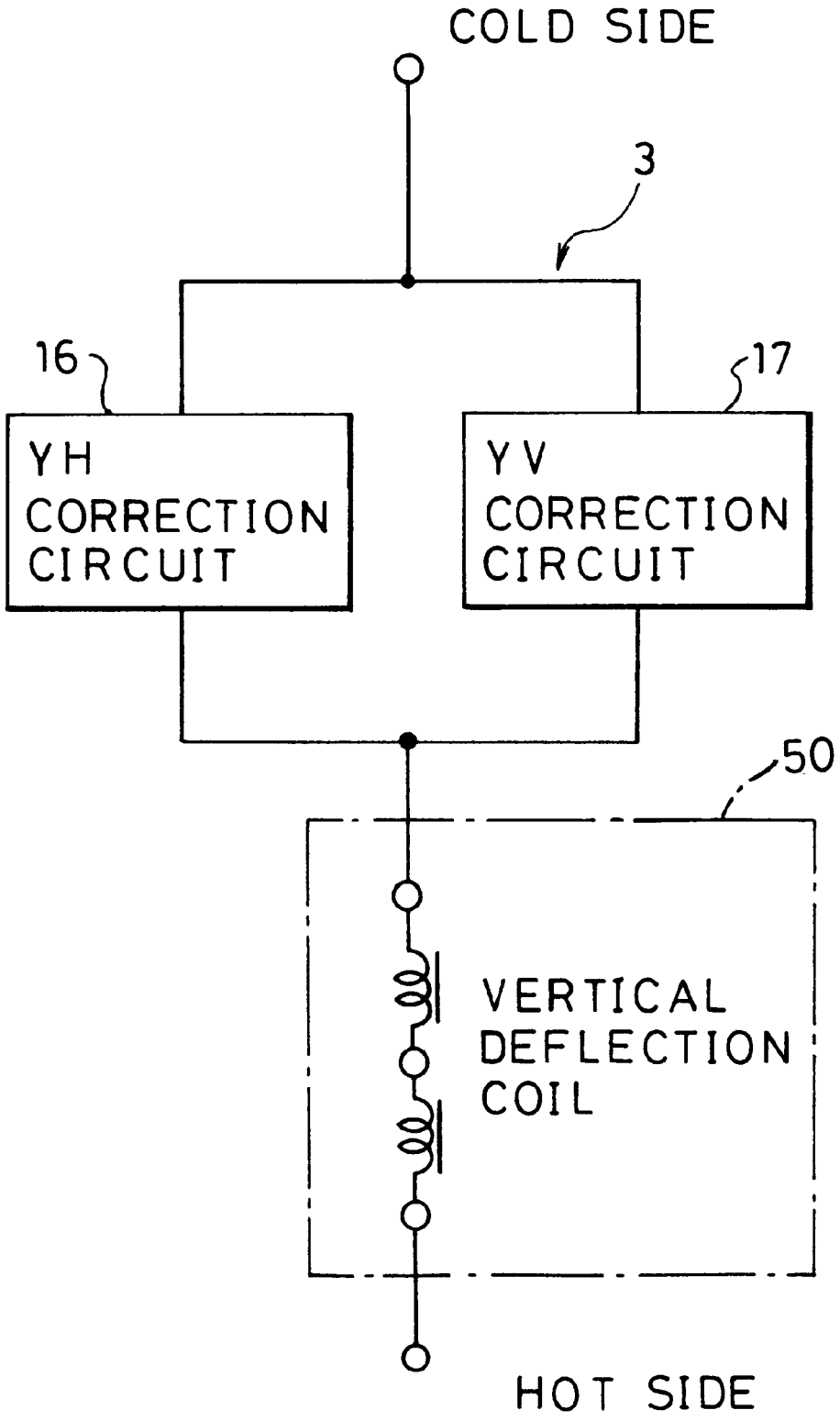
FIG. 4 is a block diagram showing a YH correction circuit and a YV correction circuit in accordance with a second embodiment of the present invention.

A second embodiment of the present invention will be described below referring to the accompanying drawings. FIG. 4 is a block diagram showing a correction circuit for a deflection yoke in a color picture tube apparatus in accordance with the second embodiment of the present invention. Similar parts and components already described in the first embodiment will be applicable, and their explanations are omitted here.

As shown in FIG. 4, the electric circuit of the main portion of the vertical deflection circuit of a deflection yoke 3 in accordance with the second embodiment has two kinds of correction circuits, that is, a YH correction circuit 16 and a YV correction circuit 17, in order to simultaneously correct two different misconvergence states, that is, YH misconvergence and YV misconvergence.

As shown in FIG. 4, the YH correction circuit 16 and the YV correction circuit 17 constituting the correction circuit in accordance with the second embodiment are connected in parallel. This correction circuit is connected to a vertical deflection coil 50 in series.

Figure 5:
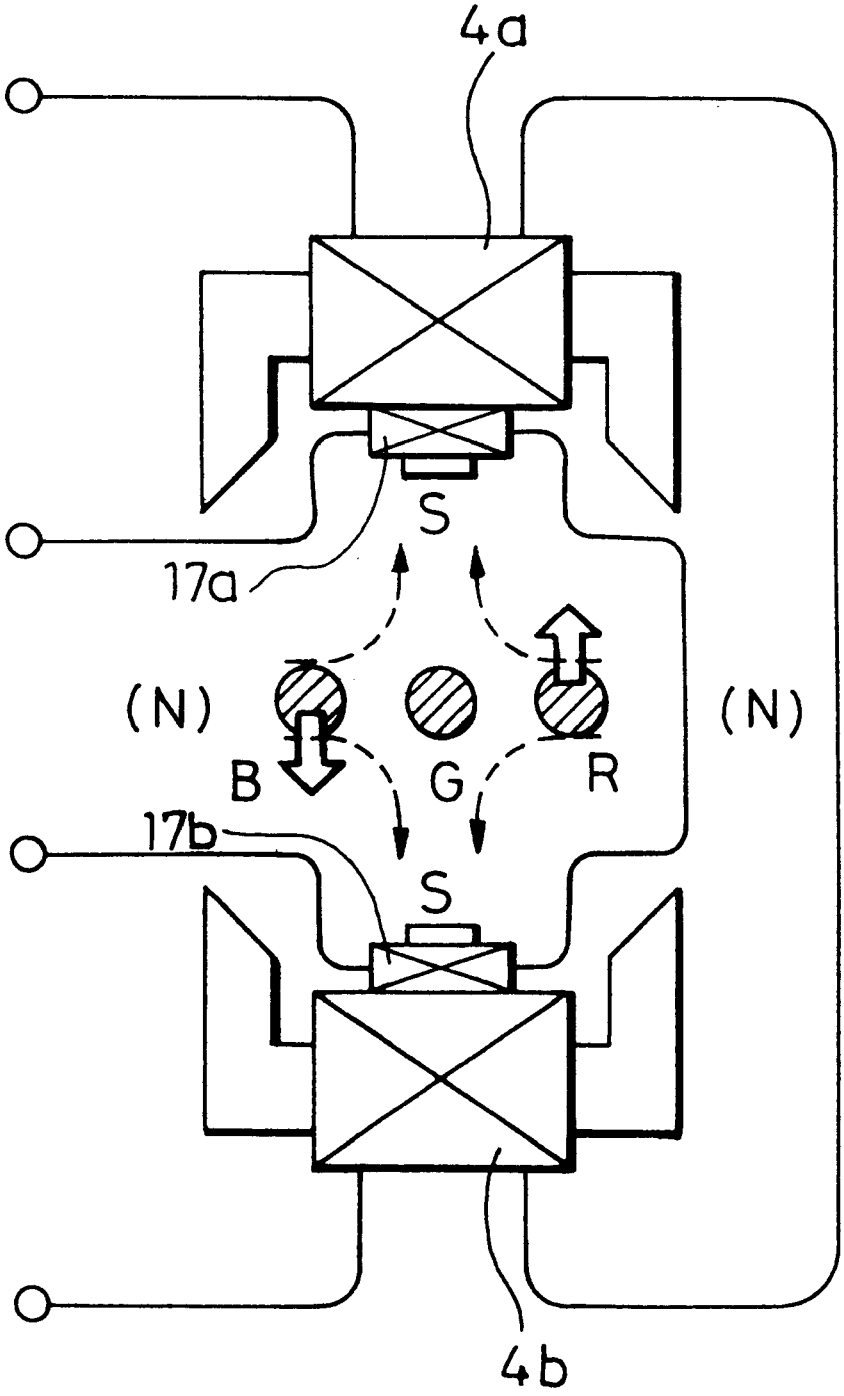
FIG. 5 is a schematic view showing YH correction coils and YV correction coils in accordance with the second embodiment of the present invention.

FIG. 5 shows a set of YH correction coils 4*a*, 4*b* and a set of YV correction coils 17*a*, 17*b* in accordance with the second embodiment, and illustrates magnetic fields generated by the set of YV correction coils 17*a*, 17*b*.

As shown in FIG. 5, the YV correction coils 17*a*, 17*b* for generating magnetic fields are provided on the electron gun side of the deflection yoke 3. The YV correction coils 17*a*, 17*b* are disposed symmetrically to each other with respect to the horizontal and vertical axes of the deflection yoke 3 so that misconvergence can be corrected by generating YV correction magnetic fields.

Figure 12:
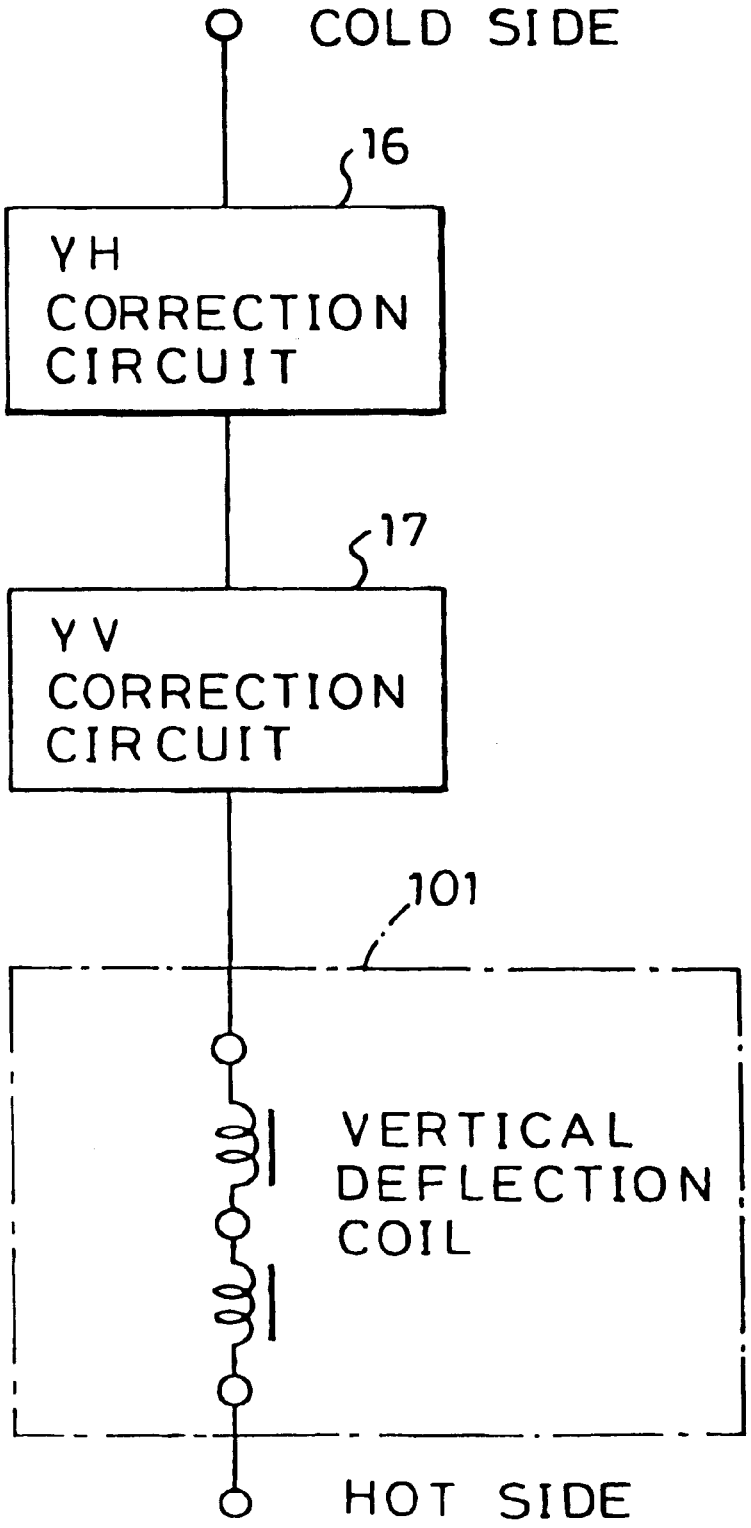
FIG. 12 (PRIOR ART)
FIG. 12 is the block diagram showing the conventional YH correction circuit and the conventional YV correction circuit.

In the aforementioned conventional correction circuit shown in FIG. 12, the YH correction coils 16 and the YV correction coil 17 are connected in series. When these coils have resistance values of 1.7 and 1.3 Ω, respectively, the total resistance value of the coils connected in series is 3.0 Ω.

On the other hand, when the YH correction circuit 16 has a resistance value of 1.7 Ω, and the YV correction circuit 17 has a resistance value of 1.3 Ω, the totally combined resistance value of the correction circuit in accordance with the second embodiment of the present invention is 0.74 Ω, since the YH and YV correction circuits are connected in parallel. Therefore, the resistance value of the correction circuit in accordance with the second embodiment of the present invention is significantly smaller than that of the conventional correction circuit, whereby circuit loss can be greatly prevented.

Third Embodiment

Figure 6:
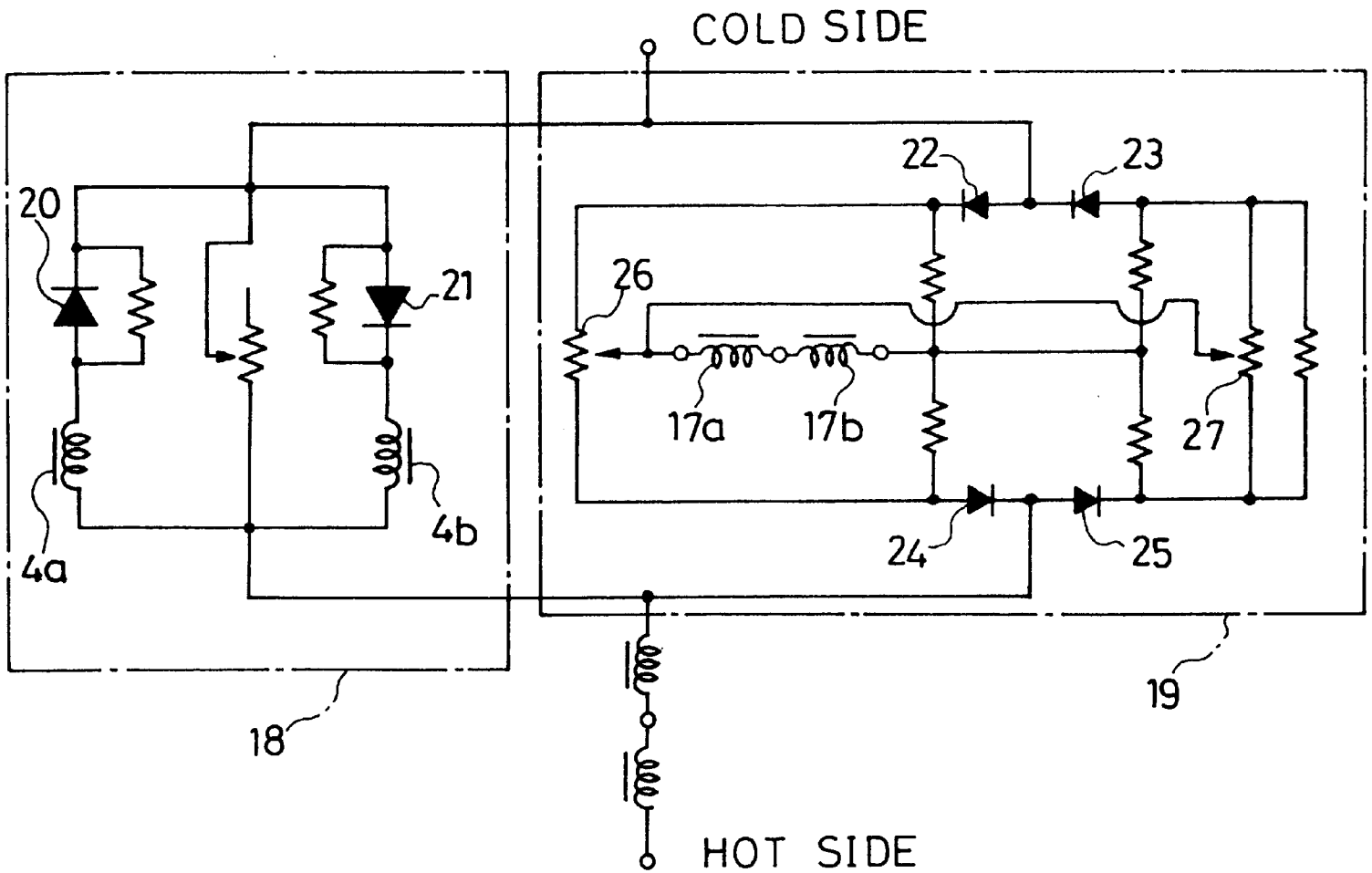
FIG. 6 is a circuit diagram showing a YH correction circuit and a YV correction circuit in accordance with a third embodiment of the present invention.

A third embodiment of the present invention will be described below referring to the accompanying drawings. FIG. 6 is a diagram showing a correction circuit for a deflection yoke in a color picture tube apparatus in accordance with the third embodiment. Similar parts and components already described in the first and second embodiments will be applicable, and their explanations are omitted here.

The correction circuit in accordance with the third embodiment is a circuit wherein the YH correction circuit 16 and the YV correction circuit 17 in accordance with the second embodiment are formed by circuits including diodes.

In FIG. 6, a YH correction circuit 18 has a diode circuit including YH correction coils 4*a*, 4*b* connected to two diodes 20, 21, respectively.

On the other hand, a YV correction circuit 19 has a diode bridge circuit including four diodes 22, 23, 24 and 25, and a set of YV auxiliary coils 17*a*, 17*b* connected to the diode bridge circuit.

As described above, in the third embodiment, the YH correction circuit 18 and the YV correction circuit 19 are electric circuits including diodes and connected in parallel. Therefore, even if the resistance values of the diodes of one of the correction circuits (the YH correction circuit 18, for example) are decreased by an increase in the ambient temperature of the color picture tube apparatus, the resistance values of the diodes of the other correction circuit (the YV correction circuit 19, for example) also decreases in the same way. As a result, the shunt ratio of currents flowing through both the YH correction circuit 18 and the YV correction circuit 19 is not theoretically affected by the increase in the ambient temperature.

Fourth Embodiment

Figure 7:
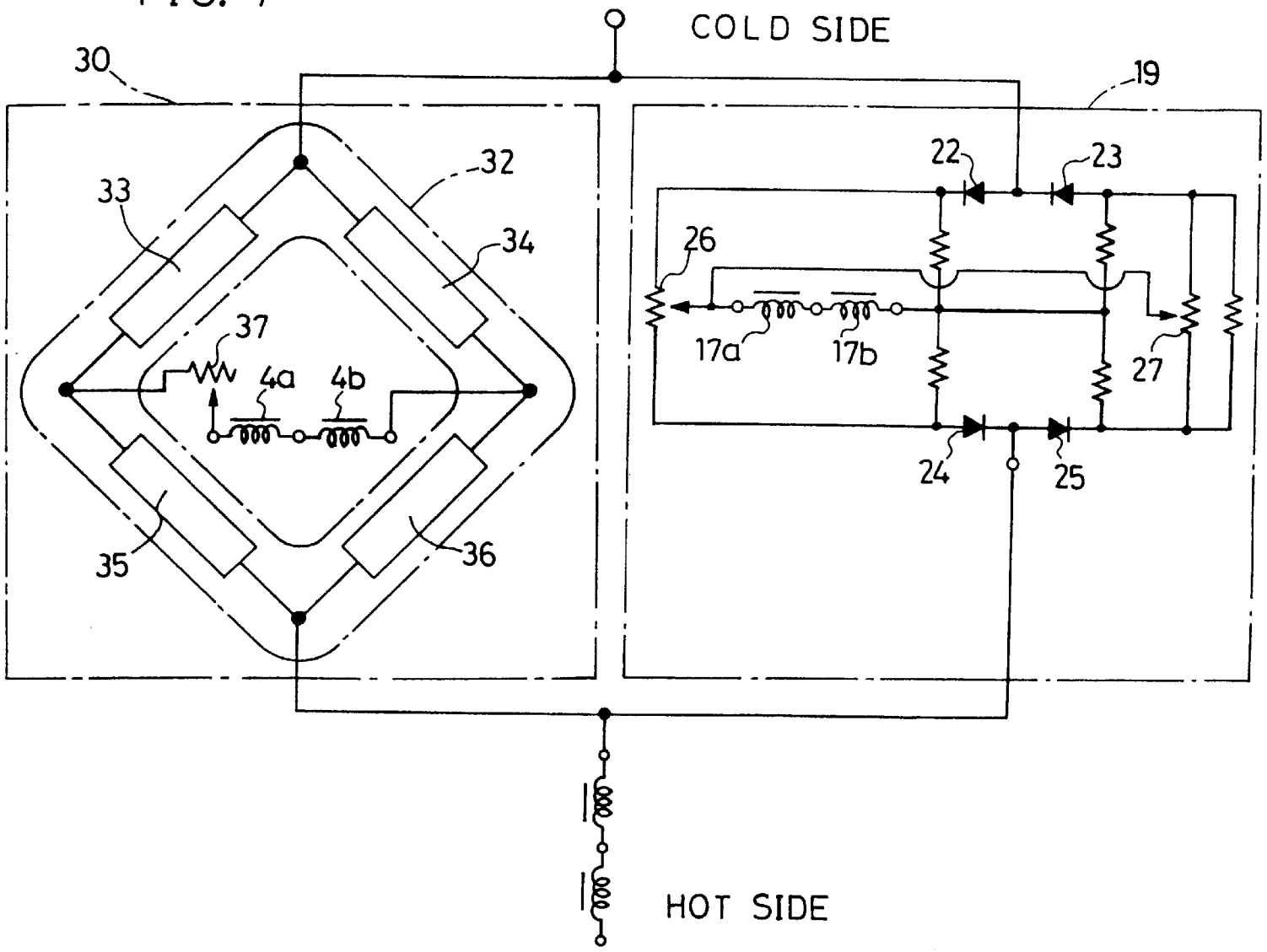
FIG. 7 is a circuit diagram showing a YH correction circuit and a YV correction circuit in accordance with a fourth embodiment of the present invention.

A fourth embodiment of the present invention will be described below referring to the accompanying drawings. FIG. 7 is a diagram showing a correction circuit for a deflection yoke in a color picture tube apparatus in accordance with the fourth embodiment of the invention. Similar parts and components already described in the first, second, and third embodiments will be applicable, and their explanations are omitted here.

As shown in FIG. 7, the correction circuit in accordance with the fourth embodiment has a YH correction circuit 30 and a YV correction circuit 19 in parallel, each formed of a bridge circuit. The YH correction circuit 30 has a bridge circuit 32 comprising four auxiliary circuits 33, 34, 35 and 36, and a set of YH auxiliary coils 4*a*, 4*b*. In addition, the YV correction circuit 19 has a diode bridge circuit comprising four diodes 22, 23, 24 and 25, and a set of YV auxiliary coils 17*a*, 17*b* connected to the diode bridge circuit.

As shown in FIG. 7, the YH correction circuit 30 and the YV correction circuit 19 in accordance with the fourth embodiment are provided with YH auxiliary coils 4*a*, 4*b* and YV auxiliary coils 17*a*, 17*b*, respectively. Furthermore, the YH correction circuit is provided with a variable resistor 37, and the YV correction circuit is provided with variable resistors 26, 27.

Since the two correction circuits constituting the correction circuit in accordance with the fourth embodiment are configured as described above, even if the shunt ratio of currents is changed by the auxiliary circuits 33 and 35 or 34 and 36 owing to a change in the resistance value of the variable resistor 37 of the YH correction circuit 30, currents flowing through the YH correction circuit 30 and the YV correction circuit 19 remain almost unchanged. This can be explained as described below. Since the YH correction circuit 30 and the YV correction circuit 19 are each formed of a bridge circuit, any change in current inside one of the YH and YV correction circuits is offset in the correction circuit, and not affect the other correction circuit. Even if current flowing through the YV correction circuit 19 is changed by the change in the resistance value of the variable resistor 37 of the YH correction circuit 30, the current is further shunted by the diodes of the YV correction circuit 19, whereby the YV auxiliary coils 17*a*, 17*b* are hardly affected. Therefore, any effect due to the change in the shunt current on the internal circuits of the bridge circuits, that is, mutual interference is hardly caused between the YH correction circuit 30 and the YV correction circuit 19 in accordance with the fourth embodiment.

According to an experiment conducted by the inventors, when the resistance value of the variable resistor 37 of the YH correction circuit 30 was changed from the maximum to the minimum in order to check for mutual interference between the bridges, the change in the amount of YV misconvergence was 0.05 mm. On the other hand, in the case that the YH correction circuit had no bridge circuit, and when the resistance value of the variable resistor of the YH correction circuit was changed from the maximum to the minimum, the change in the amount of YV misconvergence was 0.20 mm. This means that the change in convergence in the present embodiment was about a quarter, a very small and negligible level.

Fifth Embodiment

Figure 8:
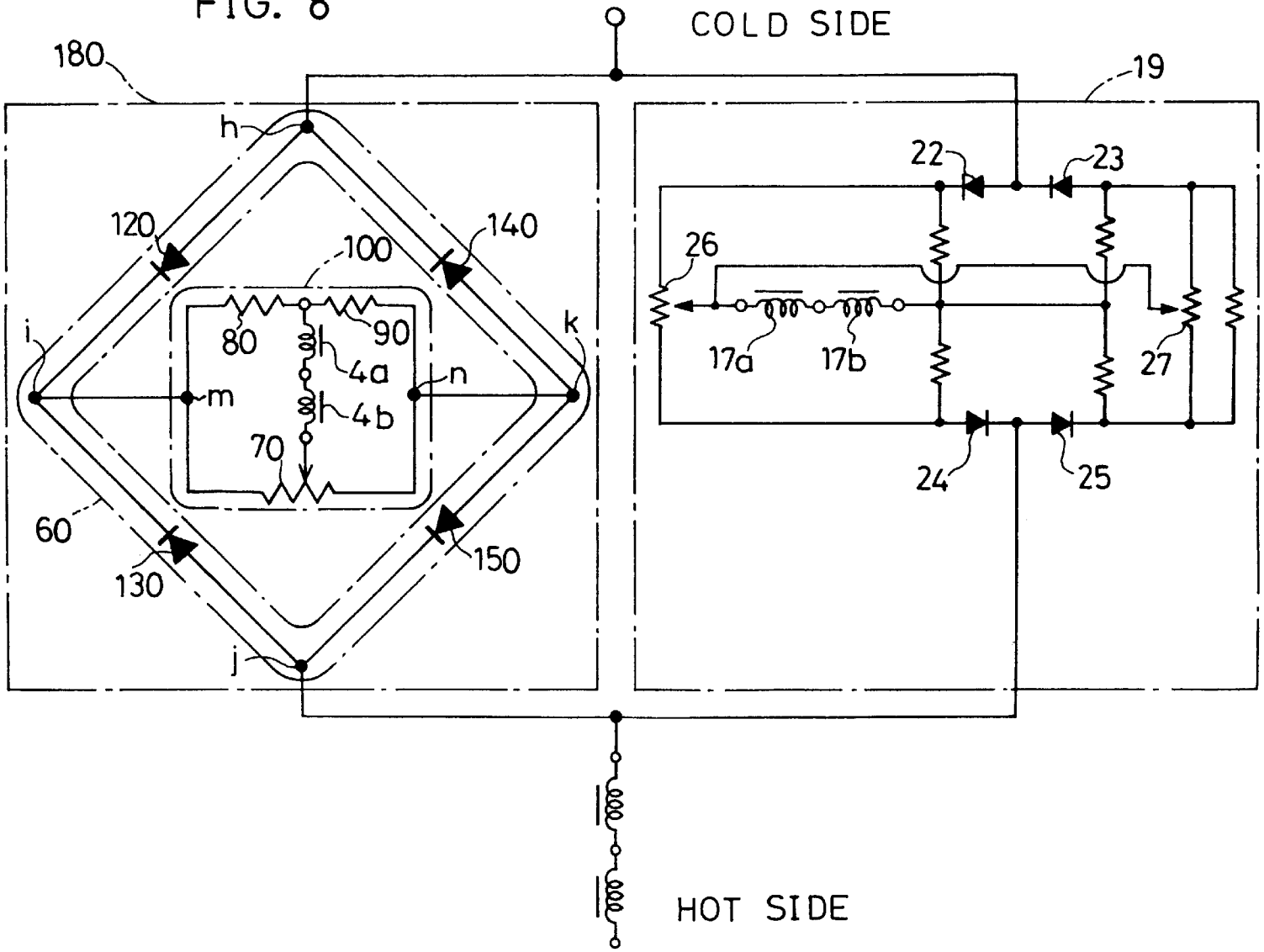
FIG. 8 is a circuit diagram showing a YH correction circuit and a YV correction circuit in accordance with a fifth embodiment of the present invention.
Figure 9:
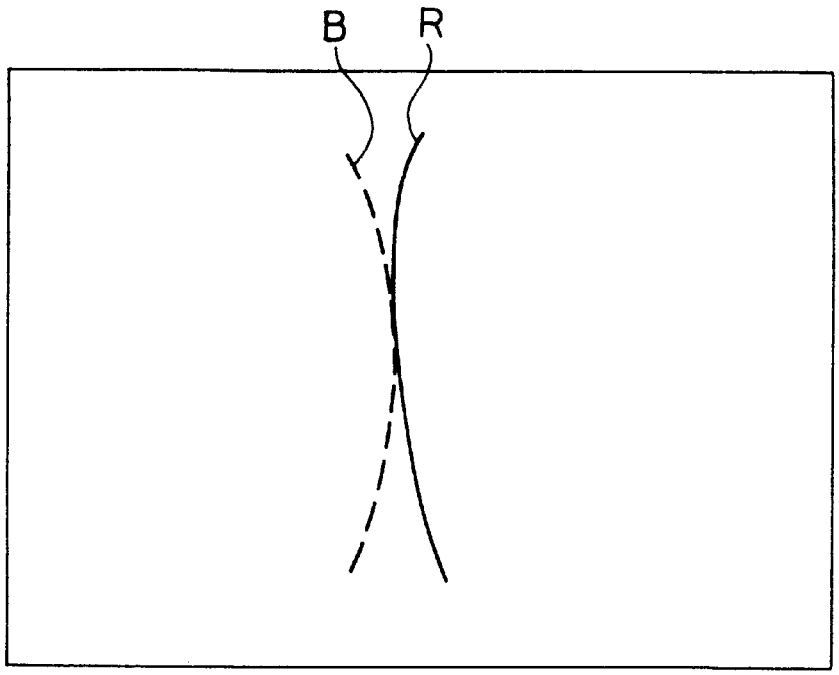
FIG. 9 is the view illustrating a state of YH misconvergence in the color picture tube.
Figure 10:
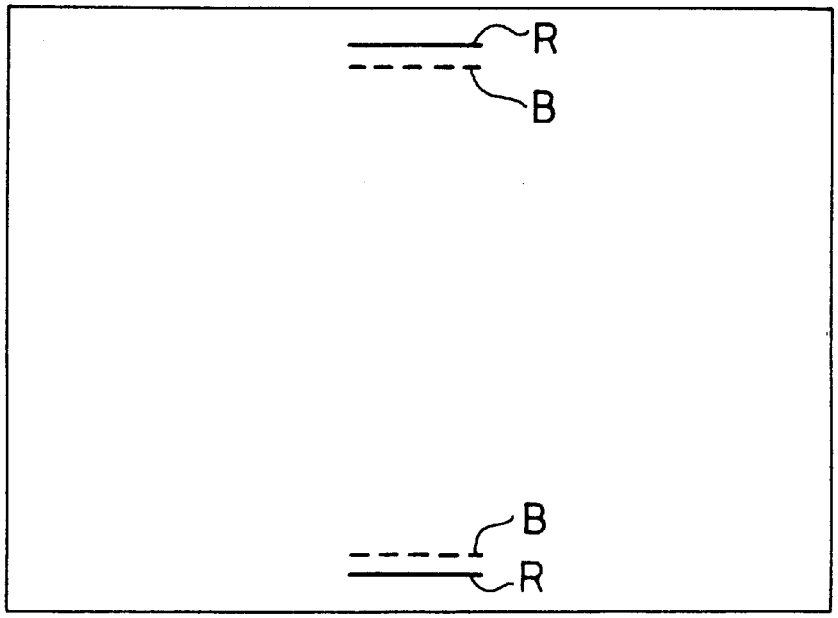
FIG. 10 is the view illustrating a state of YV misconvergence in the color picture tube.
Figure 11:
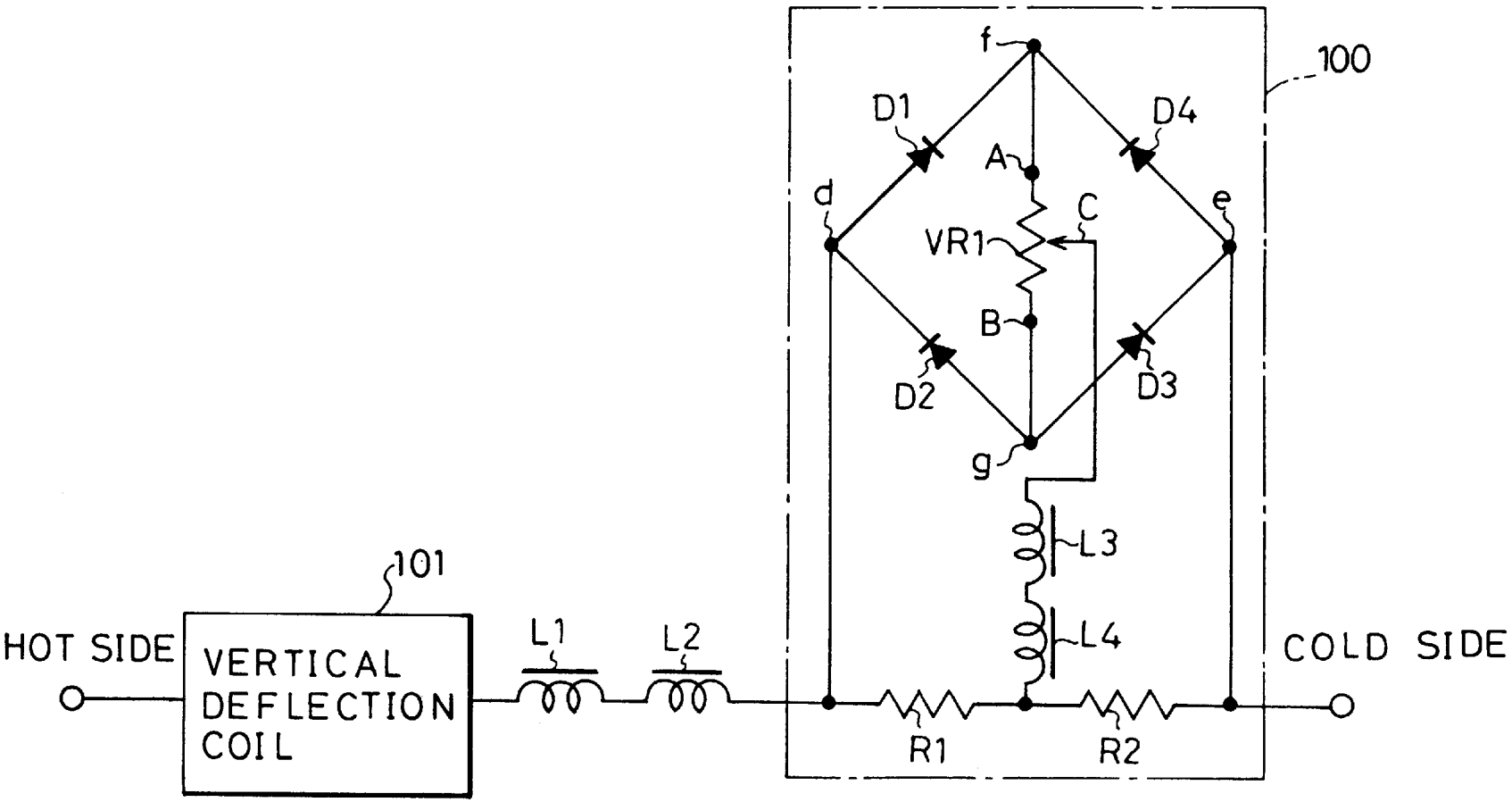
FIG. 11 (PRIOR ART)
FIG. 11 is the circuit diagram showing the conventional YH correction circuit.

A fifth embodiment of the present invention will be described below referring to the accompanying drawings. FIG. 8 is a diagram showing a correction circuit for a deflection yoke in a color picture tube apparatus in accordance with the fifth embodiment. Similar parts and components already described in the first, second, third, and fourth embodiments will be applicable, and their explanations are omitted here.

The correction circuit in accordance with the fifth embodiment is a circuit wherein the YH correction circuit 16 and the YV correction circuit 17 in accordance with the second embodiment are formed of circuits including diodes.

In FIG. 8, a YH correction circuit 180 has a diode bridge circuit 60 comprising four diodes 120, 130, 140 and 150, and a bridge circuit 100 comprising a variable resistor 70, resistors 80, 90 and a set of YH correction coils 4*a*, 4*b*.

On the other hand, a YV correction circuit 19 has the same configuration as that of the YV correction circuit 19 in the aforementioned third and fourth embodiments. The YV correction circuit 19 comprises a diode bridge circuit comprising four diodes 22, 23, 24 and 25, and a set of YV auxiliary coils 17*a*, 17*b* connected to the diode bridge circuit.

As described above, the fifth embodiment comprises the YH correction circuit 180 and the YV correction circuit 19, both including diodes and connected in parallel. Therefore, even if the resistance values of the diodes (120, 130, 140, 150) in one of the correction circuits (the YH correction circuit 180, for example) are decreased by an increase in the ambient temperature around the color picture tube, the resistance values of the diodes (22, 23, 24, 25) of the other correction circuit (the YV correction circuit 19, for example) are decreased in the same way. As a result, the shunt ratio of the currents flowing through the YH correction circuit 180 and the YV correction circuit 19 is not theoretically affected by the increase in the ambient temperature. In other words, the shunt ratio of currents flowing through the correction circuits is prevented from being changed by the temperature change, provided that the diodes used in one correction circuit are the same as those used in the other correction circuit with respect to quantity and characteristics.

The two correction circuits constituting the correction circuit of the color picture tube apparatus in accordance with the fifth embodiment include diodes, and the YH correction circuit has a double bridge circuit. Therefore, the color picture tube apparatus in accordance with the fifth embodiment has a supersensitive YH correction system.

According to an experiment conducted by the inventors, in the circuit shown in FIG. 8 including totally eight diodes, that is, four diodes for each of the YH correction circuit 180 and the YV correction circuit 19 connected in parallel, a temperature drift indicating a change in convergence was measured in a period from 20 minutes after the turn-on of a deflection operation switch to a lapse of two hours. During the measurement, YH drift in the circuit of the fifth embodiment was in the range of 0.05 mm in contrast to 0.13 mm for the conventional circuit. And YV drift was in the range of 0.05 mm in contrast to 0.20 mm for the conventional circuit. The temperature drift is represented by the maximum displacement of convergence on the screen, generated in a period from a predetermined time after the turn-on of a deflection operation switch to a lapse of a predetermined time.

As is evident from the results of the experiment, the temperature drift at the correction circuit in accordance with the fifth embodiment was able to be made far less than that of the correction circuit comprising correction circuits connected in series.

In the descriptions of the above-mentioned second to fifth embodiments of the present invention, the YV correction coil is wound around the same E-shaped core as for the YH correction coil as shown in FIG. 5. However, the present invention is not limited to this configuration. It is obvious that the present invention is applicable to all color picture tube apparatus having both the YH and YV correction coils, and that the same effects as those obtained by the above-mentioned embodiments can be obtained.

In this case, various methods are available to wind the YV correction coil, that is, a method of winding the YV correction coil around a separate core completely independent of the YH correction coil, a method of winding the YV correction coil over the foot portions on both sides of the U-shaped core of the YH correction coil, and the like.

In the present invention, the YH correction coil for generating four-pole magnetic fields has a double bridge circuit as described above. Therefore, the present invention can embody a highly sensitive YH correction system, and can provide a color picture tube apparatus having superior convergence.

In addition, the color picture tube apparatus of the present invention has a circuit configuration wherein the YH correction circuit and the YV correction circuit, which are connected to the vertical deflection coil, are connected in parallel. Therefore, the resistance value can be decreased significantly, and power consumption at the deflection yoke circuit can be reduced.

Furthermore, in the color picture tube apparatus of the present invention, the YH correction circuit and the YV correction circuit, being connected in parallel, each include diodes. Therefore, convergence adjusted for each of the YH correction circuit and the YV correction circuit can be compensated for with respect to temperature, whereby color displacement due to a change in the ambient temperature can be prevented.

Moreover, in the color picture tube apparatus of the present invention, the YH correction circuit and the YV correction circuit, being connected in parallel, each have a bridge circuit. Therefore, it is possible to prevent mutual interference between the YH correction circuit and the YV correction circuit, whereby it is possible to reduce unnecessary ITC tasks (works for adjustments of convergence, landing, etc.), such as repeated adjustments of variable resistors.

Additionally, in the color picture tube apparatus of the present invention having the circuit configuration wherein the YH correction circuit and the YV correction circuit are connected in parallel, the YH correction circuit has a double bridge circuit including a bridge circuit comprising resistors inside a diode bridge circuit. Therefore, the power consumption of the deflection yoke circuit can be reduced significantly. Furthermore, a horizontal deflection magnetic field having pincushion distortion, and a vertical deflection magnetic field having barrel distortion can be controlled as desired by using a small amount of current, whereby superior convergence can be obtained.

Although the present invention has been described in terms of the presently preferred embodiments, it is to be understood that such disclosure is not to be interpreted as limiting. Various alterations and modifications will no doubt become apparent to those skilled in the art to which the present invention pertains, after having read the above disclosure. Accordingly, it is intended that the appended claims be interpreted as covering all alterations and modifications as fall within the true spirit and scope of the invention.

What is claimed is:

1. A color picture tube apparatus comprising:

a color picture tube provided with an in-line electron gun at the neck thereof; and a deflection yoke used with said color picture tube and having a horizontal deflection coil for generating a horizontal deflection magnetic field distorted in a pincushion shape and a vertical deflection coil for generating a vertical deflection magnetic field distorted in a barrel shape, wherein said deflection yoke has a YH correction circuit connected to said vertical deflection coil in series, and said YH correction circuit has a double bridge circuit in which a diode bridge is connected to at least one resistor in parallel, and said double bridge circuit comprises two resistors which are connected in series, and which are connected to a variable resistor in parallel as a parallel connection, said parallel connection of said two resistors is further connected across the output terminals of said diode bridge circuit, and YH correction coils which are provided on the electron gun side of said deflection yoke, and which are connected between the connection point of said two resistors and the movable terminal of said variable resistor.

2. A color picture tube apparatus comprising:

a color picture tube provided with an in-line electron gun at the neck thereof; and a deflection yoke used with said color picture tube and having a horizontal deflection coil for generating a horizontal deflection magnetic field distorted in a pincushion shape and a vertical deflection coil for generating a vertical deflection magnetic field distorted in a barrel shape, wherein said deflection yoke has a YH correction circuit and a YV correction circuit connected in parallel, and said parallel connection is connected to said vertical deflection coil in series.

3. A color picture tube apparatus in accordance with claim 2, wherein said YH correction circuit and said YV correction circuit each include diodes.

4. A color picture tube apparatus comprising:

a color picture tube provided with an in-line electron gun at the neck thereof; and a deflection yoke used with said color picture tube and having a horizontal deflection coil for generating a horizontal deflection magnetic field distorted in a pincushion shape and a vertical deflection coil for generating a vertical deflection magnetic field distorted in a barrel shapes said deflection yoke having a YH correction circuit and a YV correction circuit connected in parallel, each circuit including a bridge circuit and said parallel connection is connected to said vertical deflection coil in series.

5. A color picture tube apparatus comprising:

a color picture tube provided with an in-line electron gun at the neck thereof; and a deflection yoke used with said color picture tube and having a horizontal deflection coil for generating a horizontal deflection magnetic field distorted in a pincushion shape and a vertical deflection coil for generating a vertical deflection magnetic field distorted in a barrel shape, said deflection yoke having a YH correction circuit and a YV correction circuit connected in parallel, each circuit including a bridge circuit and diodes, and said parallel connection is connected to said vertical deflection coil in series.

6. A color picture tube apparatus in accordance with claim 2, wherein said YH correction circuit is provided on the electron gun side of said deflection yoke.

7. A color picture tube apparatus in accordance with claim 3, wherein said YH correction circuit is provided on the electron gun side of said deflection yoke.

8. A color picture tube apparatus in accordance with claim 4, wherein said YH correction circuit is provided on the electron gun side of said deflection yoke.

9. A color picture tube apparatus in accordance with claim 4, wherein said YH correction circuit is provided on the electron gun side of said deflection yoke.

* * * * *